US008042472B2

(12) United States Patent
Lübbers

(10) Patent No.: US 8,042,472 B2
(45) Date of Patent: Oct. 25, 2011

(54) CARTRIDGED AMMUNITION, PARTICULARLY BLANK AMMUNITION

(75) Inventor: Thorsten Lübbers, Lütjensee (DE)

(73) Assignee: Rheimentall Waffe Munition GmbH, Unterluess (DE)

( * ) Notice: Subject to any disclaimer, the term of this patent is extended or adjusted under 35 U.S.C. 154(b) by 0 days.

(21) Appl. No.: 12/663,068

(22) PCT Filed: Feb. 25, 2008

(86) PCT No.: PCT/DE2008/000336

§ 371 (c)(1), (2), (4) Date: Aug. 2, 2010

(87) PCT Pub. No.: WO2008/148365

PCT Pub. Date: Dec. 11, 2008

(65) Prior Publication Data

US 2010/0288152 A1 Nov. 18, 2010

(30) Foreign Application Priority Data

Jun. 4, 2007 (DE) ..... 10 2007 025 981

(51) Int. Cl.
*F42B 5/02* (2006.01)

(52) U.S. Cl. ..... 102/430; 102/481; 102/202.1

(58) Field of Classification Search ..... 102/430, 102/439, 444, 481, 202.1
See application file for complete search history.

(56) References Cited

U.S. PATENT DOCUMENTS

| | | | | |
|---|---|---|---|---|
| 4,892,038 | A | 1/1990 | Lubber | |
| 5,936,189 | A | 8/1999 | Lubber | |
| 5,959,235 | A * | 9/1999 | Wagstaff | 102/202 |
| 6,615,737 | B2 * | 9/2003 | Bonnel et al. | 102/481 |
| 7,033,449 | B2 * | 4/2006 | Schaefer et al. | 149/92 |
| 7,886,667 | B1 * | 2/2011 | Baker et al. | 102/495 |

FOREIGN PATENT DOCUMENTS

| | | |
|---|---|---|
| EP | 0661251 A1 | 11/1994 |
| EP | 1241152 A1 | 12/2002 |
| GB | 348657 | 5/1931 |
| WO | 2005098348 | 10/2005 |

* cited by examiner

*Primary Examiner* — James Bergin
(74) *Attorney, Agent, or Firm* — Karl F. Milde, Jr.; Eckert Seamans Cherin & Mellott, LLC

(57) ABSTRACT

The invention relates to cartridged ammunition, particularly blank ammunition, having a cartridge shell (3) and a projectile (2) placed therein. A propellant chamber (4) accommodating a pyrotechnic of a propellant charge (5) is disposed in the cartridge shell, such charge being ignitable by an ignition device (13) also containing pyrotechnic material that generates propellant gases that act on the base (8) of the projectile and propel the shot out of the cartridge shell. In order to prevent the pyrotechnic charges of the propellant charge and/or the ignition device from self-igniting at high ambient temperatures, particularly in a fire, thus tearing apart the cartridge shell and projectile and being flung away, an inert, meltable material is mixed into the pyrotechnic charges of the propellant charge and/or the ignition device. This material has a melting temperature that is lower than the self-ignition temperature of the pyrotechnic charge with the lowest ignition temperature and, upon melting, phlegmatises the pyrotechnic charges of the propellant charge and/or the ignition device.

9 Claims, 1 Drawing Sheet

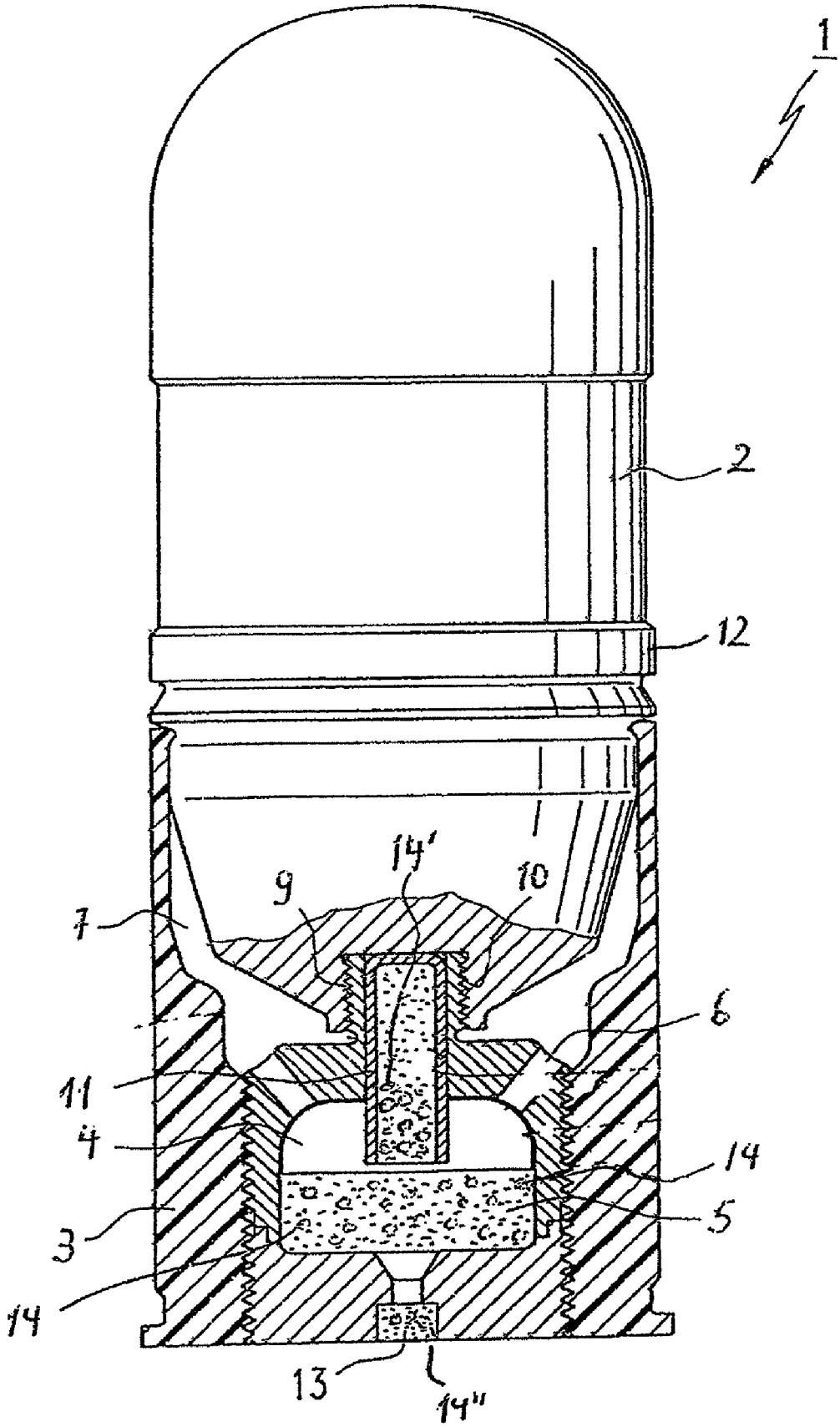
1
2
12
14'
9
10
7
6
11
4
14
3
5
14
13
14''

CARTRIDGED AMMUNITION, PARTICULARLY BLANK AMMUNITION

CROSS-REFERENCE TO RELATED APPLICATION

This application corresponds to International Application No. PCT/DE2008/00336, filed Feb. 25, 2008.

FIELD OF THE INVENTION

The invention relates to a cartridge ammunition, particularly a blank ammunition, having a cartridge shell and a projectile inserted into the same and mechanically connected with the cartridge shell. A propellant chamber is provided at the bottom of the cartridge shell, which accommodates a propellant charge which can e.g. be pyrotechnically ignited by means of a primer. The propellant gases of the propellant charge act on the bottom of the projectile after the ignition so that after the detachment of the mechanical connection between cartridge shell and projectile, the same is expelled from the cartridge shell.

BACKGROUND OF THE INVENTION

Such a cartridged blank ammunition is described in the U.S. Pat. No. 5,936,189. This cartridge ammunition is used in connection with automatic firearms of medium caliber of approx. 40 mm. A plurality of such cartridges are accommodated in a belt, which is then fed to an automatic firearm.

The propellant chamber in the cartridge shell is subdivided into a high-pressure chamber in which the propellant charge is accommodated and a low-pressure chamber which is in communication with the high-pressure chamber via overflow openings. Cartridge shell and projectile are mechanically connected via a central screw connection which is designed as a rated break point.

If the propellant charge in the high-pressure chamber is pyrotechnically ignited by means of a primer, the propellant charge burns off, develops propellant gases with a high pressure which, then, act on the projectile bottom in both chambers and finally expel the projectile from the cartridge shell, after the rated break point between cartridge shell and projectile had been broken at a specific pressure.

A similar cartridge ammunition is described in the U.S. Pat. No. 4,892,038.

Moreover, blank cartridges of this type are known, in which only a low-pressure propellant chamber is provided; such cartridges are designated as low-velocity cartridges.

A great number of pieces of such a cartridge ammunition are used and must both be safely stored and safety transported from the manufacturer to a user. As a rule, storage and transport are carried out in larger containers, e.g. sheet-metal boxes which accommodate a plurality of such cartridges.

Despite the not insignificant amount of igniting agent for primers and propellant charge, which is located in a storage or transport container, storage and transport are customarily unproblematical. At most, a fire in the storage or transport room represents a risk, during which temperature of around 220° C. and more are reached.

However, at such temperatures the pyrotechnical igniting charge of the primer is already ignited, which, then, also ignites the actual propellant charge, which, otherwise, is only ignited at from 320° C. to 400° C. After the igniting of the propellant charge such a pressure is built up as in a customary shot in the propellant chamber which acts on the projectile bottom so that, finally, after the breaking up of the mechanical connection between cartridge shell and projectile they are explosively flung apart.

A considerable damage can be caused alone due to the amount of the exploding propellant charges of a plurality of cartridges. However, the cartridge shells and projectiles which are explosively flung apart may also cause a lot of damage. Here, both cartridge shell and projectile virtually act as projectiles. Any accommodation containers are destroyed due to this, the cartridge shells and projectiles which are driven apart may also endanger persons and cause a lot of mechanical damage.

During tests such cartridges were placed into a heating dish, whereupon the heating dish was slowly heated. After the ignition temperature of the primer of about 220° C. had been reached, the primer was first of all ignited—as described—and by means of the same subsequently the propellant charge of the cartridges. Due to the building up of pressure in the propellant chamber cartridge shell and projectile are driven apart and flung up to a distance of 100 meters so that the energy which is released by many such cartridges during a fire is quite conceivable.

In order to avoid a tearing apart of cartridge shell and projectile and a damage to the environment in the case of a high increase in the outside temperature above the ignition temperature and/or self-ignition temperature of the pyrotechnical ignition charge, e.g. in the case of a fire, it is known both from DE 102004017465 and the corresponding WO 2005/098348, to provide at least one and preferably several passage(s) starting from the propellant chamber which penetrate the wall of the cartridge shell and are filled with a solid, pressure-tight, meltable material whose melting point is lower than the lowest ignition temperature of one of the pyrotechnical charges of the cartridge, i.e. lower than the ignition temperatures of the pyrotechnical ignition charge and the propellant charge.

Such a melting material is e.g. a melting metal. Such melting metals are e.g. alloys of bismuth and tin, other metals such as lead, etc. being possibly still added.

If, accordingly, a cartridge of the type in question is heated up to the melting temperature of the melting material and/or melting metal of e.g. 140° to 180° C., the melting material melts in the passages between the propellant chamber in the cartridge shell and the outside environment. If with the temperature still increasing the primer and, finally, even the propellant charge are ignited by this, no pressure can build up in the propellant chamber, since the exposed passages act as pressure relief openings. Due to this, the propellant charge only burns off, it being possible that the propellant gases generated due to this may escape through the relief openings. Cartridge shell and projectile are not separated from each other in this fashion so that neither a damage due to pressure nor a mechanical damage is caused.

This was confirmed in tests, in which a plurality of such cartridges were accommodated in a customary transport box made of sheet metal. Not even the sheet metal box was substantially damaged.

The passage or the passages irrespective of its (their) design (is) are designed in such a way that in the case of a normal shooting of the projectile from the cartridge shell the melting material withstands the high pressures within the propellant chamber.

OBJECTS OF THE INVENTION

An object of the invention is to design a cartridge ammunition of the type described above which comprises a cartridge shell and projectile, such that an explosive separation of the two components is avoided in the case of a intensive heating of the cartridge ammunition up to the range of the lowest self-ignition temperature of one of the pyrotechnical charges of the ammunition or above the same, i.e. customarily the self-ignition temperature of the primer or the propellant charge. In doing so, the geometry of the cartridge ammunition is not to be changed or additionally processed.

SUMMARY OF THE INVENTION

These objects as well as other objects which will become apparent from the discussion as follows, is achieved, according to the invention, by providing a cartridge ammunition which, in addition to the pyrotechnical charges of the propellant charge the pyrotechnical ignition device, comprises an inert meltable substance, whose melting temperature is lower than the ignition temperature of the pyrotechnical charges of either the propellant charge or the ignition device, respectively, and wich phlegmatizes the ignition device to such an extent that the ammunition can no longer be ignited by the ignition device.

Accordingly, an inert, meltable substance is introduced and/or mixed into the propellant charge, whose melting temperature is lower than the ignition temperature of the propellant charge and/or the ignition means and which at least phlegmatizes the propellant charge during melting.

Here, the inert substance is preferably incorporated into the propellant charge and is e.g. present in the form of small spheres, grains or flakes, which are mixed into the loose propellant charge powder. This substance should melt at a temperature which is below the self-ignition temperature of the pyrotechnical charge with the lowest ignition temperature. During melting of this substance the particles of the propellant charge are wetted by the inert substance so that the propellant charge is phlegmatized and/or inactivated. If the ignition means should nevertheless ignite, the propellant charge does not react or reacts only to a small extent. Anyway, such a high pressure is not generated in the propellant chamber below the projectile bottom so that cartridge shell and projectile are detached from each other with a high energy.

A wax, preferably paraffin, which melts at about 140° C. to 180° C. is particularly suitable as the inert substance.

Possibly, the inert, meltable substance may also be accommodated in an open container projecting into the propellant chamber and being particularly tubular in which, as is known from the aforementioned prior art, a flare composition is e.g. accommodated. The inert substance replaces either the flare composition or fills at least part of the flare composition.

A fine-grained or pulverulent melting metal may i.a. also be used as the inert substance, which is mixed into the pulverulent propellant charge. Such a melting metal is e.g. a metal alloy of bismuth and tin, it being possible that other metals such as lead may still be present.

A cartridge ammunition is made available with the invention, which, as opposed to a conventional cartridge ammunition according to the aforementioned prior art, is not structurally modified. Only the propellant charge is changed. Thus, a very simple manufacturing process for a safe cartridge ammunition is achieved with this.

For a full understanding of the present invention, reference should now be made to the following detailed description of the preferred embodiment of the invention as illustrated in the accompanying drawing.

BRIEF DESCRIPTION OF THE DRAWING

FIG. 1 shows a longitudinal section through a cartridge ammunition consisting of a projectile and a cartridge shell according to the invention.

DETAILED DESCRIPTION OF THE PREFERRED EXAMPLE OF EMBODIMENT

A cartridge ammunition 1 shown in the FIGURE consists of a projectile 2 and a cartridge shell 3. The cartridge shell 3 has a propellant chamber 4 in which a propellant charge 5 of a pyrotechnical charge is disposed.

The wall of the propellant chamber 4 is provided with overflow openings 6 which end in a low-pressure chamber 7 which is located below the projectile bottom 8. The propellant chamber 4 is provided with a central threaded connecting piece 9, which engages into a central thread 10 in the projectile bottom 8. A tubular flare composition 11 can still be connected with the projectile bottom 8, which, starting from the threaded connecting piece 9, immerses into the propellant charge 4.

The cartridge ammunition 1 has a caliber of e.g. 40 mm and is inserted into the lock of a gun not shown here, from which the projectile 2 is shot with a twist, for which purpose the projectile has a guide and/or twist band 12 which is (are) only outlined here.

The propellant charge 5 is pyrotechnically ignited by a primer 13, which is centrally inserted into the bottom of the cartridge shell 3.

Small particles, such as spheres, grains or flakes of an inert substance 14, in this case of a paraffin, are mixed into the granular bulk of the propellant charge 5, the amount of the admixture being dimensioned in such a way that in the case of a proper shot of the cartridge ammunition the combustion of the propellant charge 5 is substantially not hindered. However, if the ambient temperature of the cartridge ammunition should increase to more than the self-ignition temperature of the ignition means, which is e.g. approx. 180 to 220° C. e.g., during a fire, the individual particles 14 of the inert substance in the propellant charge 5 melt so that the same is at least phlegmatized or even inactivated. Even in the case of an ignition of the primer 13 the propellant charge 5 would then not explosively ignite.

Instead of a wax, in this case paraffin, metal alloys of bismuth and tin with any additives may also be used as the inert substance, which also have a very low melting point in the range of about 140° C. and cause a wetting and thus a phlegmatizing of the propellant charge during a fire in a similar fashion.

In addition to the admixture of an inert substance 14 or instead of the admixture in the propellant charge 5 this inert substance may also be included in the tubular flare composition 11 as this is outlined by the reference numeral 14'.

In addition, the small pyrotechnical charge of the primer 13 could also be mixed with such an inert substance which is outlined by 14".

Even if preferred examples of embodiment of the invention were described above, it is evident for a person skilled in the art that alterations and modifications of the examples of embodiment are possible without deviating from the object of the invention.

What is claimed is:

1. A cartridge ammunition having a cartridge shell and a projectile inserted into the cartridge shell and mechanically connected with it, a propellant charge comprising a pyrotechnical charge, provided in a propellant chamber of the cartridge shell, which is ignited with an ignition device also containing a pyrotechnical charge and whose propellant gases exert a pressure on the bottom of the projectile upon combustion, by means of which the projectile is expelled from the cartridge shell, the improvement wherein, an inert, meltable substance is incorporated into the pyrotechnical charges of the propellant charge and/or the pyrotechnical ignition device, whose melting temperature is lower than the ignition temperature of the pyrotechnical charges of the propellant charge and/or the ignition device and which, upon the melting, phlegmatizes the pyrotechnical charges of the propellant charge and/or the ignition device to such an extent that the ammunition can no longer be ignited by the ignition device.

2. The cartridge ammunition according to claim 1, wherein the inert, meltable substance is incorporated into the pyrotechnical charge of the propellant charge.

3. The cartridge ammunition according to claim 1, wherein the inert, meltable substance is accommodated in an open container which projects into the pyrotechnical charge of the propellant charge.

4. The cartridge ammunition according to claim 1, wherein the inert, meltable substance is admixed to at least one of the pyrotechnical charge of the propellant charge and the ignition means in the form of small units selected from the group consisting of spheres, grains and flakes.

5. The cartridge ammunition according claim 1, wherein the inert, meltable substance wets the charge of at least one of the propellant charge and the ignition means upon melting.

6. The cartridge ammunition according to claim 5, characterized in that the inert, meltable substance is a wax.

7. The cartridge ammunition according to claim 6, wherein the wax is paraffin.

8. The cartridge ammunition according to claim 1, wherein the inert, meltable substance is a melting metal.

9. The cartridge ammunition according to claim 8, wherein the melting metal is a metal alloy containing at least bismuth and tin.

* * * * *